US005711285A

United States Patent [19]

Stewart et al.

[11] Patent Number: 5,711,285

[45] Date of Patent: Jan. 27, 1998

[54] WRIST-MOUNTED PROJECTILE LAUNCHER

[75] Inventors: Randolph C. Stewart, Cincinnati, Ohio; Daniel G. Meiser, Butler, Ky.; Robert L. Brown, Cincinnatti, Ohio

[73] Assignee: Hasbro, Inc., Pawtucket, R.I.

[21] Appl. No.: 681,807

[22] Filed: Jul. 29, 1996

[51] Int. Cl.[6] ..... F41B 11/14

[52] U.S. Cl. ..... 124/67; 124/84

[58] Field of Search ..... 124/56, 58, 59, 124/66, 67, 83, 84

[56] References Cited

U.S. PATENT DOCUMENTS

| | | | |
|---|---|---|---|
| 3,262,440 | 7/1966 | Kuhn | 124/67 |
| 3,453,774 | 7/1969 | Breneman et al. | 446/353 |
| 3,869,825 | 3/1975 | Heberlein | 446/433 |
| 4,529,389 | 7/1985 | Kennedy et al. | 446/26 |
| 4,642,066 | 2/1987 | Kennedy et al. | 446/420 |
| 4,768,681 | 9/1988 | Dean et al. | 222/79 |
| 5,242,323 | 9/1993 | Rappaport | 446/180 |
| 5,316,514 | 5/1994 | Ellman et al. | 446/26 |
| 5,359,985 | 11/1994 | Schumacher | 124/66 |
| 5,460,560 | 10/1995 | Liu | 446/23 |

*Primary Examiner*—John A. Ricci

*Attorney, Agent, or Firm*—Marshall, O'Toole, Gerstein, Murray & Borun

[57] ABSTRACT

There is disclosed a wrist-mounted projectile launcher having pivoting launch tubes and a handle that remain in inoperative and convenient positions until it is desired to launch projectiles. The launch tubes and handle are spring-loaded and moved to operative positions simply by pushing a button. A selector valve mechanism can be used to select which of the tubes will launch a projectile.

22 Claims, 5 Drawing Sheets

WRIST-MOUNTED PROJECTILE LAUNCHER

FIELD OF THE INVENTION

This invention relates generally to projectile launchers and particularly to a wrist-mounted projectile launcher having pivoting launch tubes and a handle that remain in inoperative and convenient positions until it is desired to launch projectiles. The launch tubes and handle are spring-loaded and moved to operative positions simply by pushing a button. A selector valve can be used to launch a projectile from one tube at a time.

Hand and wrist-mounted devices for launching projectiles are disclosed in U.S. Pat. Nos. 4,529,389; 5,316,514; and 5,359,985. The '985 patent discloses a mitt that is secured to a user's wrist. Spring-loaded projectile launchers are cocked and fired using triggers that are accessible to the fingers and thumb. A wrist-mounted vehicle launcher is disclosed in the '389 patent and it uses a battery-operated spinning device that rotates a fly wheel in the vehicle prior to release. The vehicle can be stored on a platform on the launcher when not in use. Further, a launching swivel arm is provided to accommodate its form to the shape of the hand of the player. The '514 patent discloses a glove-like apparatus from which a toy vehicle can be launched. In these patents, the launch mechanisms are always directed away from the user and always extend outward, even when not in use. Further, they can only fire a single projectile before reloading.

Other patents disclose pneumatic projectile launchers having multiple launch tubes that selectively receive compressed gas via valves. U.S. Pat. No. 5,343,850 discloses a double shot projectile launcher having a bellows that transmits compressed air to one of two projectiles through a valve. The valve mechanism includes a spring-loaded trigger for moving a planar slide valve from a normally down position to an up position against the urging of a spring. To fire the upper projectile, the user must simultaneously hold the trigger back using a finger from one hand and compress a bellows with the other hand to feed compressed gas through the sliding valve to the upper launch tube. This is a complicated mechanism to operate because the user must hold the trigger back to keep the valve open with one hand, and push the bellows down to launch a projectile from the upper tube with the other hand.

U.S. Pat. No. 5,267,549 discloses an air-powered toy gun with two barrels that selectively fire projectiles using pressurized air from a cylinder. The particular barrel that fires depends upon the direction a piston is moved through the cylinder because the launch tubes are in fluid communication with opposite ends of the cylinder. In this manner, the piston cylinder acts as a valve to control the direction of air flow and select which launch tube will be used.

Both the '850 patent and the '549 patent disclose guns that are hand-held and must be set down when the user wishes to hold something else. Further, both of these patents disclose projectile launchers with long and indiscreet launch tubes that cannot be concealed easily.

Thus, it is desirable to have a wrist-mounted, multi-barrel projectile launcher with a hands-free valve for selectively directing compressed gas to one of the launch tubes. Further, it is desirable to have a wrist-mounted projectile launcher with the ability to pivot the launch tubes and an aiming handle to an inoperative and convenient position when not in use, and with a mechanism for quickly returning these components to an active position when needed.

SUMMARY OF THE INVENTION

A wrist-mounted projectile launcher in accordance with the present invention is easy to operate and has active components that can be pivoted to inoperative and convenient positions when not in use. A simple mechanism is provided for quickly pivoting the members back to an operative position when needed and a selector valve can be turned to select a firing launch tube prior to firing.

One embodiment of the wrist-mounted projectile launcher includes: a housing; wrist mounting connectors joined to the housing; a launch tube pivotally joined to the housing for movement between an inoperative and an operative position; a launch tube spring biasing the launch tube toward the operative position; a handle pivotally joined to the housing for movement between an inoperative position and an operative position; a handle spring for biasing the handle toward the operative position; a sear for releasably engaging the handle and launch tubes in their respective inoperable positions; and a pneumatic launcher joined to the housing, and in fluid communication with the launch tube.

The wrist-mounted projectile launcher may include a second launch tube pivotally joined to the housing for movement between an operative position and an inoperative position; and a launch tube coupler for joining the launch tubes for synchronized pivoting of the launch tubes between the operative position and the inoperative position. When two or more launch tubes are used the wrist-mounted projectile launcher may include a selector valve in communication with the pneumatic launcher for selectively launching projectiles from either launch tube.

Further, when the wrist-mounted projectile launcher includes more than one launch tube, a selector valve may comprise a manifold for directing compressed gas to one of the launch tubes and not the other.

The wrist-mounted projectile launcher of claim 1 in which the handle comprises a cylinder having a detent portion; and the sear comprises a ratchet arm pivotally joined to the housing for pivoting movement into engagement with the detent portion of the cylinder when the launch tube is in the inoperative position.

The sear may include a button; and the launch tube may include a tab to be engaged by the button when the launch tube is in the inoperative position.

The wrist-mounted projectile launcher's pneumatic device may include a cylinder joined to the housing; a piston slidably disposed in the cylinder between a cocked and an uncocked position; and a hose for communicating compressed gas from the cylinder to the launch tube.

A wrist-mounted projectile launcher in accordance with the present invention may comprise: a housing; a wrist mounting connector joined to the housing; a plurality of projectile launch tubes pivotally joined to the housing for movement between an inoperative position and an operative position; a launch tube spring biasing the projectile launching tubes toward the operative position; a handle pivotally joined to the housing for movement between an inoperative position and an operative position; a handle spring biasing the handle toward the operative position; a sear joined to the housing for releasably securing the launch tubes and the handle in their respective inoperative positions; and a pneumatic launcher in fluid communication with the launch tubes.

This embodiment of the wrist-mounted projectile launcher may include a selector valve for selecting a launch tube to communicate with the pneumatic launcher.

The wrist-mounted projectile launcher may also include a valve rotatably joined to the housing and having an orifice that rotates to selectively communicate compressed gas from the pneumatic launcher to a single launch tube.

The pneumatic launcher may include a cylinder joined to the housing; a piston slidably disposed in the cylinder between a cocked and an uncocked position; and a hose for communicating compressed gas from the cylinder to at least one of the launch tubes.

The handle may comprise a cylinder having an arcuate detent portion; and the sear may comprise a ratchet arm pivotally joined to the housing for pivoting movement into engagement with the arcuate detent portion of the cylinder when the launch tube is in the inoperative position.

The launch tubes may include a coupler tab joined to the launch tubes; and the sear may include a button for engaging the launch tube coupler tab when the launch tubes are in the inoperative position.

The sear may include: a button extending upwardly out of the housing and movable between an up locked position and a down unlocked position; and a button spring for biasing the button toward the up locked position.

The wrist-mounted projectile launcher of claim 9 in which the wrist mounting elements include a plurality of flexible and adjustable straps.

DETAILED DESCRIPTION OF THE DRAWINGS

Figure 1:
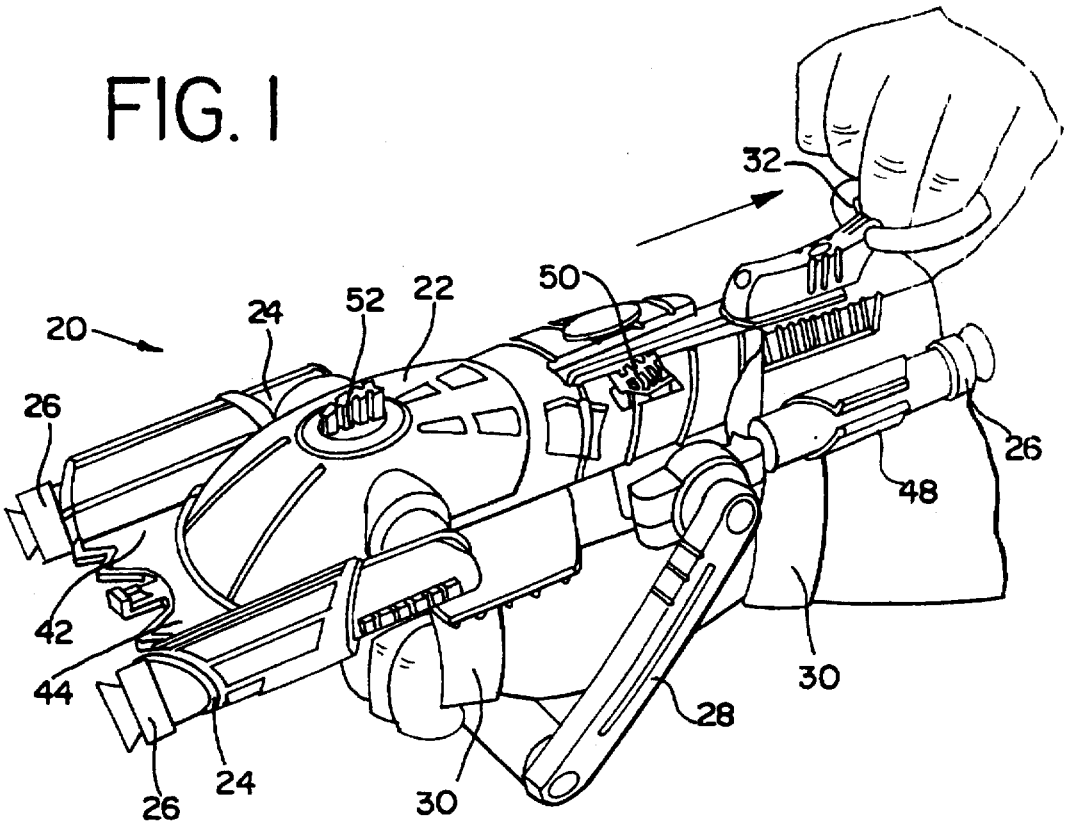
FIG. 1 is a perspective view of a wrist-mounted projectile launcher in accordance with the present invention.

To the extent practical, the same reference numerals will be used with the same element in each of the figures. Illustrated in FIG. 1 is a wrist-mounted projectile launcher 20 in accordance with the present invention which includes a housing 22, a pair of parallel and pivotable launch tubes 24 in which plastic-tipped foam darts 26 are positioned, a pivotable aiming handle 28, a pair of adjustable wrist-mounting straps 30, and a grip ring 32.

The housing 22 is a hollow shell, preferably manufactured of plastic in upper and lower halves that can be screwed, sonic welded, or secured together by other means. The housing 22 is preferably shaped in the form of a stylized futuristic weapon, as illustrated, but it can be of any shape or style as play criteria require.

The pair of launch tubes 24 are sized to receive foam darts 26 in a snug fit, however the tubes 24 can be of any suitable size to accommodate projectiles of different sizes and shapes. The launch tubes 24 are maintained in a parallel relationship by a coupler 42 that has two bores therethrough for receiving the launch tubes 24.

Figure 2:
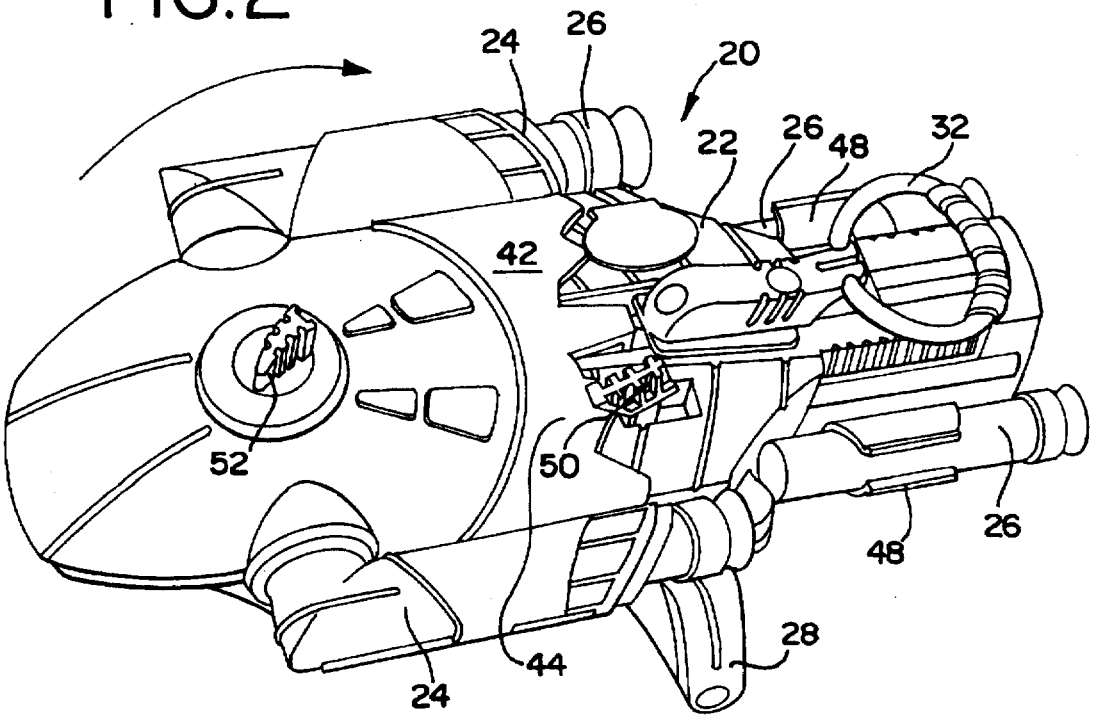
FIG. 2 is a perspective view of the projectile launcher with launch tubes in an inoperative position.

As stated above, the launch tubes 24 are pivotally joined to the housing 22 so when directed forward (FIG. 1) the launch tubes 24 are in an operable position and when pivoted rearward (as illustrated in FIG. 2) the launch tubes 24 are in an inoperable, but convenient, position.

The housing 22 also includes the adjustable straps 30 that preferably include hook-and-loop connectors for easy adjustment and attachment to a user's wrist and hand under the housing 22. The adjustable straps 30 are sized to provide a secure fit between the launcher 20 and the user's hand and wrist so that when the launcher 20 is being fired, the launcher 20 will not slip and cause misfires or poorly aimed shots.

The aiming handle 28 also pivots between an operable forward position (FIG. 1) and an inoperable rearward position (FIG. 2). The handle 28 provides optimum control for aiming when grasped by a user. The handle 28 is pivotable to the inoperable position so that it is out of the way to free the user's hand for other purposes when the launcher 20 is not in use. When the aiming handle 28 is in its inoperable rearward position, the user can hold other things with minimal interference from the strap 30. The pivoting motion of the launch tubes 24 and handle 28 also adds significantly to the play value of the toy.

Other features can be mounted on the housing 22 such as extra dart clips 48 for storing spare projectiles 26.

Generally, the launcher 20 operates by manually pivoting the aiming handle 28 and the launch tubes 24 back out of the way. A release button 50 extending upward through an opening in the housing 22 acts as a sear to maintain the launch tubes 24 and handle 28 in a spring-loaded or cocked position. When pushed down, the release button 50 releases the launch tubes 24 and aiming handle 28 from their respective inoperative positions so that they can pivot automatically to their respective operative positions.

The release button 50, as illustrated in FIG. 2 engages a tab 44 on the launch tube coupler 42. Because the launch tubes 24 are spring-loaded (described in detail below), the release button 50 in the illustrated position, will hold the launch tube coupler bridge 42 and launch tubes 24 down into the inoperable rearward position. The release button 50 also engages the aiming handle 28 inside the housing 22 as described below in relation to FIGS. 11 to 14.

When the release button 50 has been pushed and the launch tubes 24 the aiming handle 28 pivot forward, the grip ring 32 is pulled back and forth (FIGS. 3 and 4) to fire darts 26. Which dart is fired (left or right) depends upon the position of the valve switch 52 which communicates pressurized gas from an internal pneumatic device to one of the launch tubes.

More specific details of the launcher 20 operation are depicted in FIGS. 5 to 10 where there is the dart 26 firing mechanism and a pneumatic device 54 is illustrated that is capable of launching foam darts 26 from the launch tubes 24. The pneumatic device 54 includes a cylinder 56 maintained stationary relative to the housing 22 by a forked tab 58 that can be screwed to a portion of the housing 22 and by brackets which are molded integrally in the housing. A hose nipple 61 is formed at one end of the cylinder 56.

Figures 5, 6, 7:
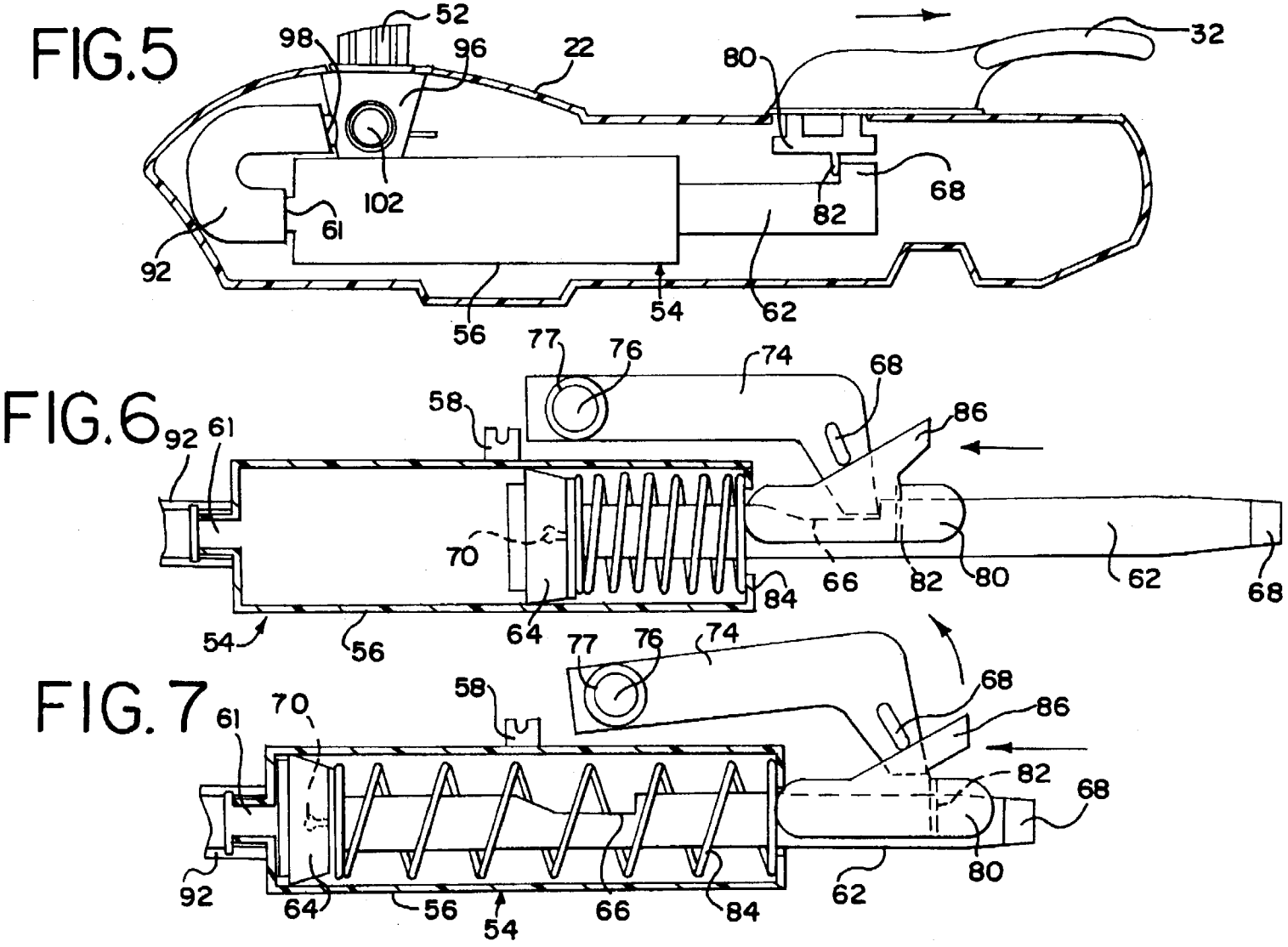
FIG. 5 is a cross-sectional side view of the projectile launcher illustrating a pneumatic launcher.
FIG. 6 is a cross-sectional plan view of a pneumatic launcher in a cocked position.
FIG. 7 is a cross-sectional plan view of the pneumatic launcher of FIG. 6 in an uncocked position.

As best seen in FIGS. 6 and 7, inside the cylinder 56 there is a piston 62 that includes a piston seal 64 at its fore end, a notch 66 in the middle, and an upwardly extending tab 68 at the rear end.

The piston seal 64 has a diameter slightly larger than the inside diameter of the cylinder 56 to compress the seal 64 slightly and provide good sealing contact between the seal 64 and the cylinder 56. The seal 64 is joined to the fore end of the piston 62 by pushing a pin 70 with an oversized head through a small hole in the seal 64.

The piston notch 66 has a ramped fore portion and a vertical rear portion. The notch 66 is engaged by a piston latch 74 that holds the piston 62 in a cocked position. Stability for the piston 62 when it is out of the cylinder 56 can be provided by a channel inside the housing 22. As illustrated in FIG. 5, the piston 62 is cocked by pulling the grip ring 32 which is attached to a grip frame 80. The grip frame 80, includes a transverse contact surface 82 that engages the piston tab 68 to pull the piston 62 back against the force of a piston spring 84 which surrounds the piston 62 and is disposed inside of the cylinder 56.

In the top views of FIGS. 6 and 7, it can be seen that the piston latch 74 is an L-shaped lever that is mounted on a post 76. A torsion spring 77 is used to bias the piston latch 74 toward the piston 62. In this manner, when the grip ring 32, grip frame 80, and piston 62 are pulled back, the piston latch 74 pivots (due to the torsion spring 77) and engages the piston notch 66. The piston 62 is biased forward by the piston spring 69 so the engagement between the piston notch 66 and the piston switch 74 remains firm.

Figure 3:
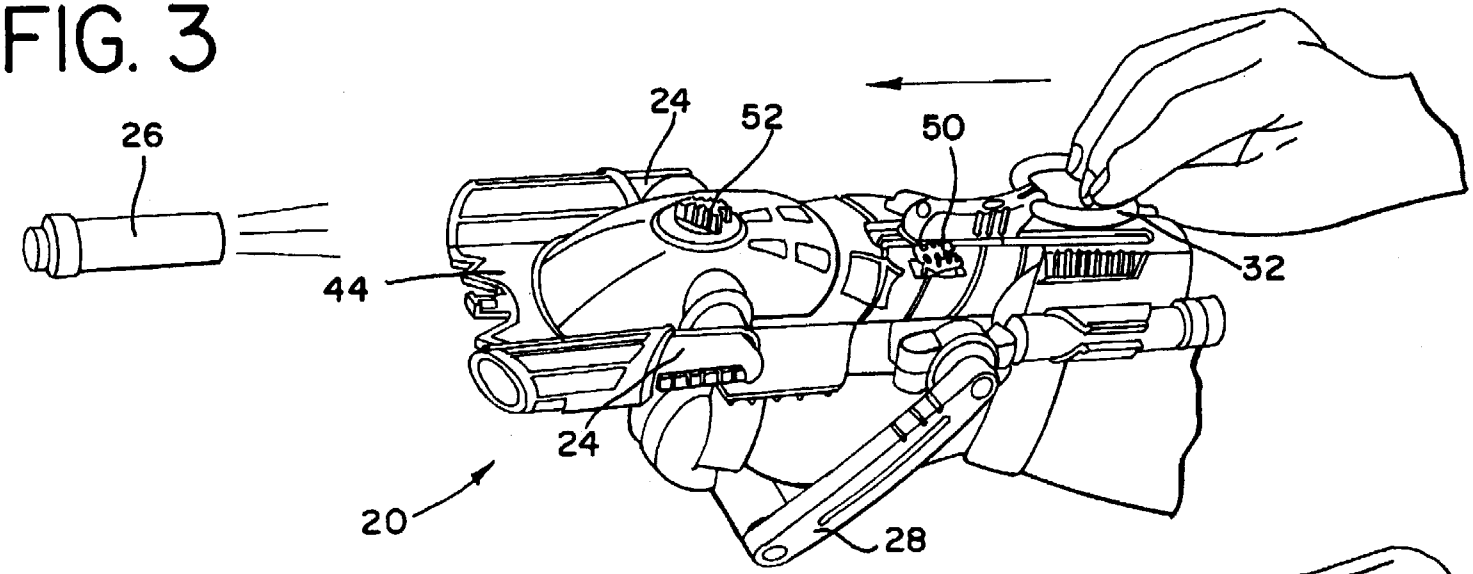
FIG 3 is a perspective view of the projectile launcher firing a projectile from a right launch tube.
Figure 4:
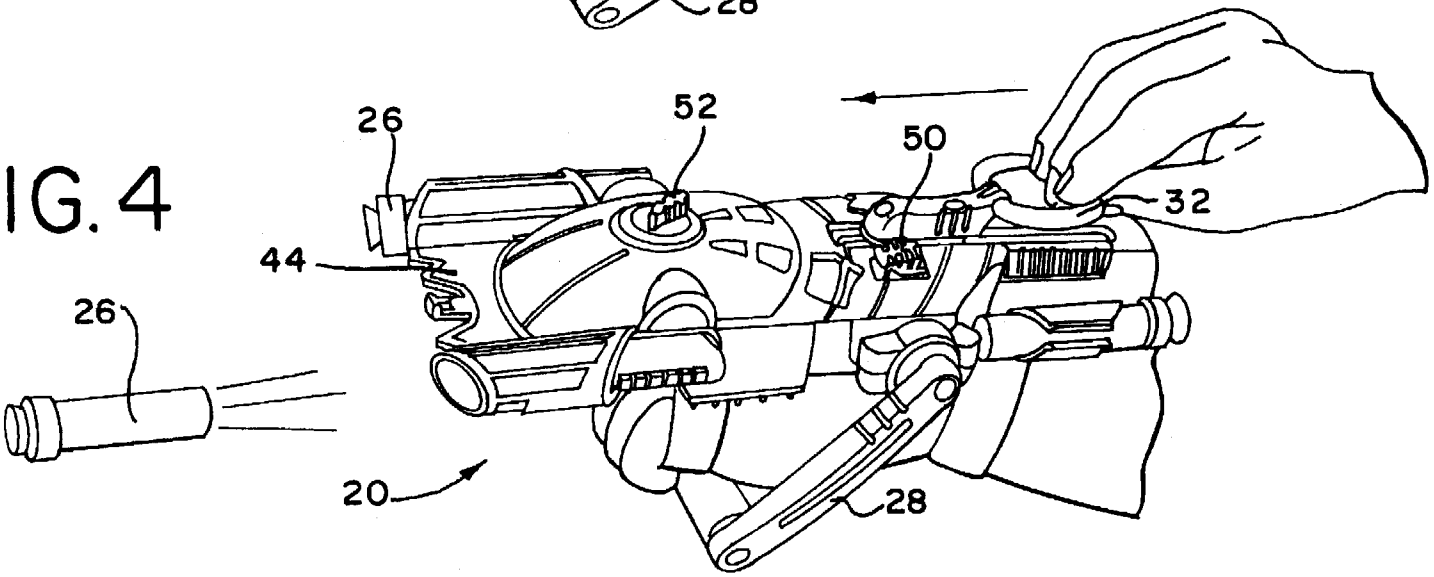
FIG 4 is a perspective view of the projectile launcher firing a projectile from a left launch tube.

To release the piston 62 and compressed air out of the cylinder nipple 61, the 9rip ring 32 is pushed forward (FIGS. 3 and 4). Because the grip frame 80 and piston tab 68 are not connected, the piston 62 will remain cocked while the grip ring 32 is moved forward. As the grip ring 32 moves forward, a ramped release 86 on the grip frame 80 engages a release tab 68 on the piston latch 74 so that the piston latch 74 is pivoted away from the piston 62, and out of engagement with the piston notch 66. At that point the piston spring 84 urges the piston 62 forward quickly to compress air in the cylinder 56 and force the compressed air out of hose nipple 61.

Figure 8:
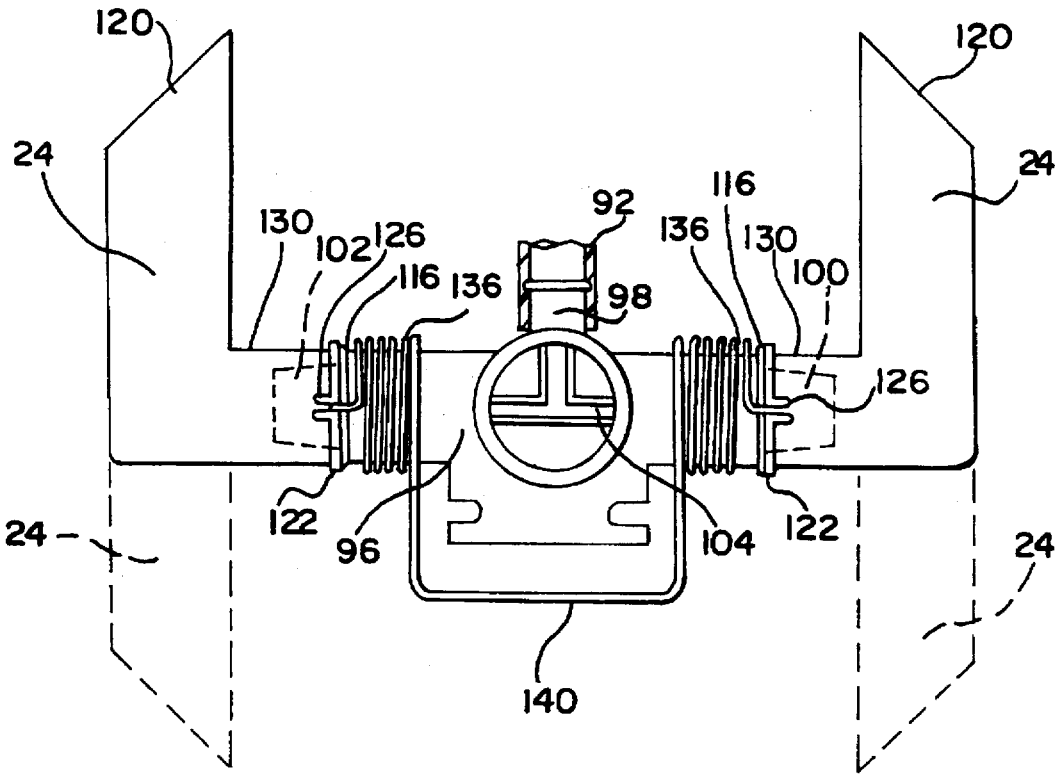
FIG. 8 is a plan view of a manifold and launch tubes.
Figure 9:
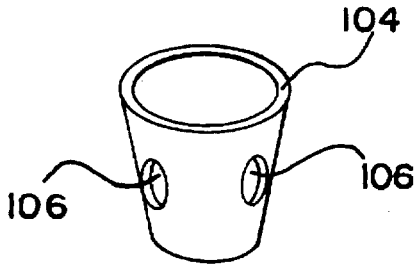
FIG. 9 is a perspective view of a selector valve.

As seen in FIGS. 5 and 8, the compressed air passes through the hose nipple 61, and up and back through a short, flexible section of hose 92 with an inner spring (not illustrated) to prevent the hose 92 from kinking. The hose 92 feeds air to a manifold 96 having an inlet 98 and two outlets 100 and 102. Positioned between the inlet 98 and the outlets 100 and 102 is a rotary valve 104 which is hollow and has two ports 106 (FIG. 9) positioned ninety degrees apart so rotating the valve 104 ninety degrees provides a conduit between the inlet 98 and either outlet 100 or outlet 102, but not both. This means that for each firing of the piston 62 only one projectile corresponding to the outlet presently in communication with the inlet 98 will be launched. The user of the launcher 20 can select which projectile to launch by turning the valve switch 52 (preferably supplied with an indicator such as an arrow for showing which tube will fire) extending through the top of the housing 22. The valve 104 is preferably conical in shape for ease of installation and optimal sealing with the manifold 96.

Figure 10:
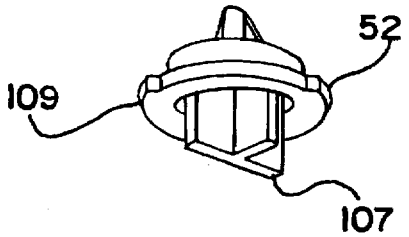
FIG. 10 is a perspective view of a selector switch.
Figure 11:
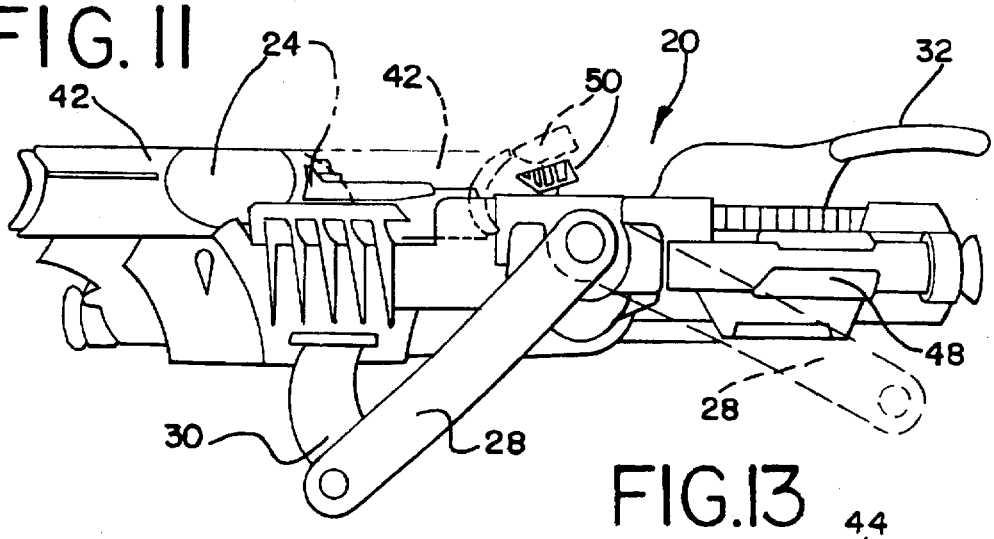
FIG. 11 is a side of the projectile launcher with the inoperative positions of the launch tubes and the handle illustrated in dashed lines.

As illustrated in FIGS. 8 and 10, the switch 52 and rotary valve 104 interlock due to a T-shaped key way provided in the top of the valve 104 which receives a T-shaped key 107 in the bottom of the switch 52. The switch 52 is also provided with a flange 109 that bears on the inside of the housing so that the switch 52 cannot be removed.

The outlets 100 and 102 on the manifold 96 each have a tapering outside diameter, an o-ring seal 116, and grease where they each will fit into launch tubes 24.

The launch tubes 24 are generally L-shaped with a stylized tapered opening 120 in which the foam darts 26 are inserted. At the opposite end there is a retaining ring 122 that is preferably molded integrally with each launch tube 24 that prevents the launch tube 24 from being pulled from the housing 22 and enabling the launch tube 24 to pivot freely. Notches 126 in the retaining ring 122 provide locations to receive ends of torsion spring 128 that provides for automatic pivoting movement of the launch tubes 24 from their inoperative positions (dashed lines in FIG. 8) to their operative positions (solid lines in FIG. 8).

The manifold outlets 100 and 102 fit into launch tube ends 130 and are maintained in position by the housing 22 when assembled. In this manner, compressed air can flow from the manifold 96 to either one of the launch tubes 24. The grease and o-ring seals 116 are adequate to prevent substantial amounts of air escaping from the junction between the manifold 96 and the launch tubes 24 while permitting the launch tubes 24 to pivot back and forth.

As indicated above, the launch tubes 24 are designed to pivot out of the way when not in use. The launch tubes 24 are manually pivoted up and back to the inoperative position. When this is done, tension is applied to a torsion spring 136 which is positioned over both outlet ends of the manifold 96. The ends of the torsion spring 136 are positioned in notches 126 on the launch tubes 24. A bridge portion 140 of the torsion spring 136 joins the coiled portions of the spring 136.

Next, details of the pivoting mechanisms for the launcher 20 are illustrated in FIGS. 11 to 14. In the illustrated embodiment, the release button 50 acts as a sear to maintain the launch tubes 24 and handle 28 in the inoperative position. Separate sears could be used, but one in the form of the button 50, is preferred. The launch tube coupler 42 includes a central portion having a coupler tab 44 that is engaged by an underside of the release button 50 to hold the launch tube 24 in a rearward and inoperative position until the button 50 is pushed and rotates clockwise enough to release the launch tube coupler 42 and permit the tube spring 136 to pivot the tubes 24 forward into an operative position.

Figure 12:
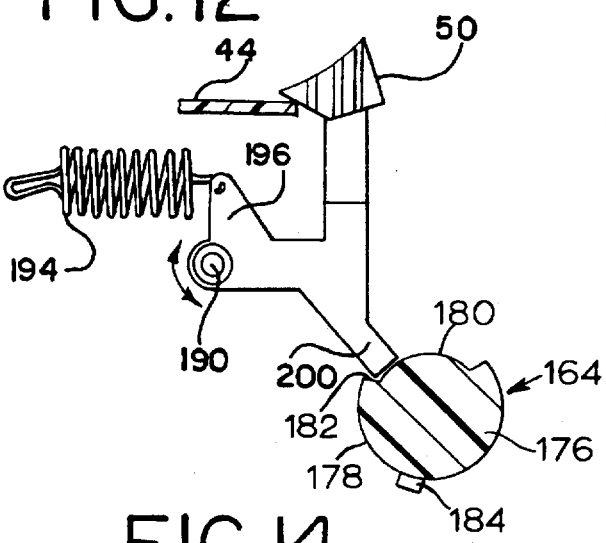
FIG. 12 is a cross-sectional view of a release button and portions of the launch tube coupler and aiming handle in an inoperative position.
Figure 13:
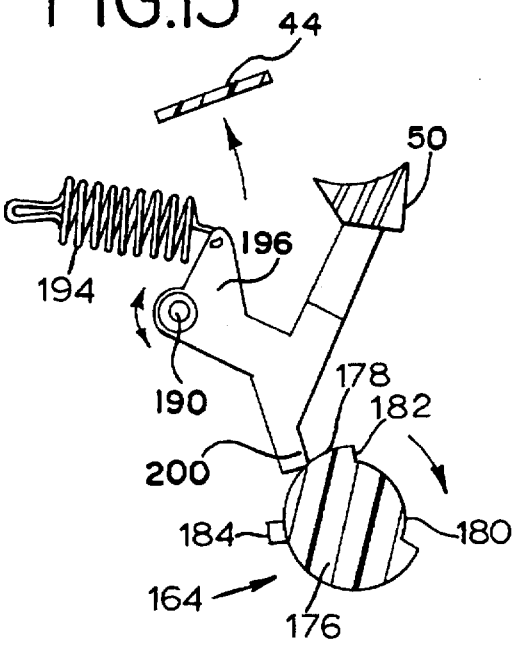
FIG. 13 is the button, launch tube coupler, and aiming handle of FIG. 12 with the release button pivoted back.

The aiming handle 28, which includes a palm grip 160, a lever arm 162, and a pivot end 164. The pivot end 164 includes a neck 168 that extends through the housing 22 and has a low coefficient of friction therewith. The pivot end 164 also includes a trip hub 176 which extend slightly inward toward the center of the housing 22. The trip hub 176 is configured as illustrated in FIGS. 12 and 13, and includes an arcuate surface 178, a detent surface 180, a vertical stop 182, and a tab 184 to engage an inner surface in the housing 22 prevent over-travel when the handle 28 is flipped into the operative position.

Figure 14:
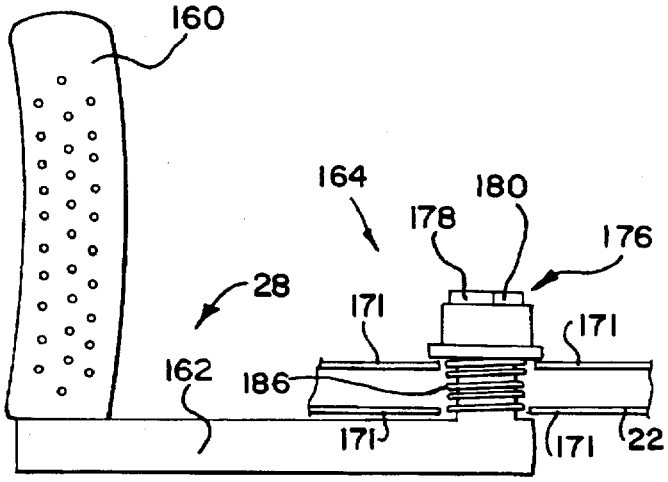
FIG. 14 is an aiming handle in accordance with the present invention.

The trip end 176 of the handle 28 interacts with a torsion handle spring 186 and the release button 50 to enable the handle 28 to pivot between a forward operative position and a rearward inoperative position where it is out of the user's way until needed. The handle spring 186 is maintained between two flanges 171 in the housing 22 (FIG. 14).

The release button 50 includes a trunnion 190 that rotates in a rounded bracket within the upper housing half. A button spring 194 engages a short upper lever arm 196 and biases the release button 50 in a counter-clockwise direction (as illustrated). A ratchet arm 200 extends down and back from the bottom of the button 50.

As the aiming handle 28 is pivoted backward, tension is applied to handle spring 186 and the ratchet arm 200 slides over the trip end's arcuate surface 178 at the biasing of the button spring 194 until the trip end 176 rotates far enough that the ratchet arm 200 is urged to the detent surface 180. The handle spring 186 urges the ratchet arm 200 into firm contact with the vertical stop 182. The handle 28 remains in place until the button 50 is pushed down to release the ratchet arm 200 from the stop 182 and the handle 28 is rotated by the handle spring 186 into a forward operative position in the user's hand.

In this manner, the pivoting handle 28 and launch tubes 24 can be pivoted back into a cocked position (FIGS. 2, 11, and 12) until the user wishes to launch a projectile 26. The release button 50 is pressed down and pivots slightly back to release both the launch tube coupling tab 44, and the aiming handle hub end 176 which are then both pivoted automatically by springs to their respective operative positions.

At this point, the user selects a tube 24 to fire by rotating the valve switch 52. The grip ring 32 is pulled back to cock the piston 62 and pushed forward to release the piston 62 which, in turn, compresses air released through the manifold and into a launch tube 24. The fit between the projectile 26 and the launch tube is such that the air launches the projectile out of the tube 24. The next projectile can be launched by rotating the valve switch 52 and manipulating the grip ring 32 as described.

The above detailed description is provided for clearness of understanding only and no unnecessary limitations therefrom should be read into the following claims.

We claim:

1. A wrist-mounted projectile launcher comprising:

a housing;

a wrist mounting connector joined to the housing;

a projectile launch tube pivotally joined to the housing for movement between an inoperative position and an operative position;

a launch tube spring biasing the launch tube toward the operative position;

a handle pivotally joined to the housing for movement between an operative position and an inoperative position;

a handle spring biasing the handle toward the operative position;

a sear for releasably engaging the launch tube and handle in their respective inoperative positions; and a launcher mounted to the housing and in communication with the launch tube.

2. The wrist-mounted projectile launcher of claim 1, and further comprising:

a second launch tube pivotally joined to the housing for movement between an operative position and an inoperative position; and a launch tube coupler for joining the launch tubes for synchronized pivoting movement of the launch tubes between the operative position and the inoperative position.

3. The wrist-mounted projectile launcher of claim 2, and further comprising:

a selector in communication with the launcher for selectively launching projectiles from either launch tube.

4. The wrist-mounted projectile launcher of claim 3 in which the selector comprises a manifold for directing compressed gas to one of the launch tubes and not the other.

5. The wrist-mounted projectile launcher of claim 1 in which the handle comprises a cylinder having an arcuate detent portion; and the sear comprises a ratchet arm pivotally joined to the housing for pivoting movement into engagement with the arcuate detent portion of the handle cylinder when the handle is in the inoperative position.

6. The wrist-mounted projectile launcher of claim 1 in which the launch tube includes a tab; and the sear includes a button for engaging the launch tube tab when the launch tube is in the inoperative position.

7. The wrist-mounted projectile launcher of claim 1 in which the launcher comprises:

a cylinder joined to the housing;

a piston slidably disposed in the cylinder between a cocked position and an uncocked position to compress gas; and a hose for communicating compressed gas from the cylinder to the launch tube.

8. The wrist-mounted projectile launcher of claim 1 in which the wrist mounting elements are adjustable straps.

9. A wrist-mounted projectile launcher comprising:

a housing;

a wrist mounting connector joined to the housing;

a plurality of projectile launch tubes pivotally joined to the housing for movement between an inoperative position and an operative position;

a launch tube spring biasing the projectile launching tubes toward the operative position;

a handle pivotally joined to the housing for movement between an inoperative position and an operative position;

a handle spring biasing the handle toward the operative position;

a sear joined to the housing for releasably securing the launch tubes and the handle in their respective inoperative positions; and a pneumatic launcher in fluid communication with the launch tubes.

10. The wrist-mounted projectile launcher of claim 9, and further comprising:

a valve for selecting a launch tube to communicate with the pneumatic launcher.

11. The wrist-mounted projectile launcher of claim 9, and further comprising:

a valve rotatably joined to the housing and having an orifice that rotates to selectively communicate compressed gas from the pneumatic launcher to a single launch tube.

12. The wrist-mounted projectile launcher of claim 9 in which the launcher comprises:

a cylinder joined to the housing;

a piston slidably disposed in the cylinder between a cocked and an uncocked position to compress gas; and a hose for communicating compressed gas from the cylinder to the launch tube.

13. The wrist-mounted projectile launcher of claim 9 in which the handle comprises a cylinder having an arcuate detent portion; and the sear comprises a ratchet arm pivotally joined to the housing for pivoting movement into engagement with the arcuate detent portion of the cylinder when the launch tube is in the inoperative position.

14. The wrist-mounted projectile launcher of claim 9 in which the launch robe includes a tab; and the sear includes a button for engaging the launch tube tab when the launch tube is in the inoperative position.

15. The wrist-mounted projectile launcher of claim 9 in which the sear release includes:

a button extending upwardly out of the housing and movable between an up locked position and a down unlocked position; and a button spring for biasing the button toward the up locked position.

16. The wrist-mounted projectile launcher of claim 9 in which the wrist mounting elements include a plurality flexible and adjustable straps.

17. A wrist-mounted projectile launcher comprising:

a housing;

a wrist mounting connector joined to the housing;

a projectile launch tube pivotally joined to the housing for movement between an inoperative position and an operative position;

a launch tube spring biasing the launch tube toward the operative position;

a sear for releasably engaging the launch tube in the inoperative position; and a launcher mounted to the housing and in communication with the launch tube.

18. The wrist-mounted projectile launcher of claim 17, and further comprising:

a second launch tube pivotally joined to the housing for movement between an operative position and an inoperative position; and a launch tube coupler for joining the launch tubes for synchronized pivoting movement of the launch tubes between the operative position and the inoperative position.

19. The wrist-mounted projectile launcher of claim 18, and further comprising:

a selector in communication with the launcher for selectively launching projectiles from either launch tube.

20. The wrist-mounted projectile launcher of claim 19 in which the selector comprises a manifold for directing compressed gas to one of the launch tubes and not the other.

21. The wrist-mounted projectile launcher of claim 17 in which the launch tube includes a latch; and the sear includes a button for engaging the launch tube latch when the launch tube is in the inoperative position.

22. The wrist-mounted projectile launcher of claim 17 in which the launcher comprises:

a cylinder joined to the housing;

a piston slidably disposed in the cylinder between a cocked position and an uncocked position to compress gas; and a hose for communicating compressed gas from the cylinder to the launch tube.

* * * * *